US011060035B2

(12) United States Patent
Wang et al.

(10) Patent No.: US 11,060,035 B2
(45) Date of Patent: Jul. 13, 2021

(54) METHODS FOR ENHANCING EFFICIENCY OF BITUMEN EXTRACTION FROM OILSANDS USING ACTIVATED CARBON CONTAINING ADDITIVES

(71) Applicant: ADVEN INDUSTRIES, INC., Edmonton (CA)

(72) Inventors: Tianfei Wang, Edmonton (CA); Weixing Chen, Edmonton (CA)

(73) Assignee: ADVEN INDUSTRIES, INC., Edmonton (CA)

( * ) Notice: Subject to any disclaimer, the term of this patent is extended or adjusted under 35 U.S.C. 154(b) by 0 days.

(21) Appl. No.: 16/314,061

(22) PCT Filed: Jun. 30, 2017

(86) PCT No.: PCT/CA2017/000164

§ 371 (c)(1),
(2) Date: Dec. 28, 2018

(87) PCT Pub. No.: WO2018/006155

PCT Pub. Date: Jan. 11, 2018

(65) Prior Publication Data

US 2019/0241814 A1 Aug. 8, 2019

(51) Int. Cl.
*C10G 1/04* (2006.01)
*B03B 9/02* (2006.01)

(52) U.S. Cl.
CPC ..... *C10G 1/047* (2013.01); *B03B 9/02* (2013.01); *C10G 2300/807* (2013.01)

(58) Field of Classification Search
CPC ..... C10G 1/045; C10G 1/047
See application file for complete search history.

(56) References Cited

U.S. PATENT DOCUMENTS

| | | | | |
|---|---|---|---|---|
| 3,767,570 | A * | 10/1973 | Clapp | C02F 3/087 210/618 |
| 3,835,064 | A | 9/1974 | Shinomiya et al. | |
| 3,876,451 | A | 4/1975 | Zall et al. | |
| 3,953,345 | A | 4/1976 | Saito et al. | |
| 3,969,268 | A | 7/1976 | Fukuda et al. | |
| 4,118,341 | A | 10/1978 | Ishibashi et al. | |
| 5,102,855 | A | 4/1992 | Greinke et al. | |
| 5,504,050 | A | 4/1996 | Hayden | |
| 7,410,510 | B2 | 8/2008 | Fujino et al. | |
| 7,541,312 | B2 | 6/2009 | Dietz et al. | |
| 8,709,972 | B2 | 4/2014 | Istvan et al. | |
| 8,759,253 | B2 | 6/2014 | De Leede | |
| 8,784,764 | B2 | 7/2014 | Gadkaree | |
| 8,807,220 | B2 * | 8/2014 | Madison | E21B 43/24 166/272.1 |
| 8,927,103 | B2 | 1/2015 | Kirschbaum et al. | |
| 2005/0207962 | A1 | 9/2005 | Dietz et al. | |
| 2014/0011666 | A1 | 1/2014 | Yoshizaki et al. | |
| 2014/0037536 | A1 | 2/2014 | Reimerink-Schats et al. | |
| 2014/0175688 | A1 | 6/2014 | Bohnert et al. | |
| 2015/0329364 | A1 | 11/2015 | Dong et al. | |
| 2016/0368774 | A1 | 12/2016 | Mitre et al. | |

FOREIGN PATENT DOCUMENTS

| | | | | |
|---|---|---|---|---|
| CA | 1223834 A | * | 7/1987 | C10G 1/047 |
| CA | 2880959 C | * | 10/2016 | C10G 1/047 |
| EP | 2081676 A1 | | 7/2009 | |
| EP | 2478957 A1 | | 7/2012 | |
| WO | 2007114849 A2 | | 10/2007 | |
| WO | 2009011590 A1 | | 1/2009 | |

OTHER PUBLICATIONS

Ncibi et al. (2008), "Recent Patents on Activated Carbon Production and Applications", Recent Patents on Chemical Engineering, 2008, 1, 126-140.

Guo et al. (1999), "Textural and chemical characterizations of activated carbon prepared from oil-palm stone with H2SO4 and KOH impregnation", Microporous Mesoporous Mats, 1999, 32, 111-117.

Lillo-Rodenas et al. (2001), "Preparation of activated carbons from Spanish anthracite: II. Activation by NaOH", Carbon, 2001, 39, 751-759.

Gurten et al. (2012), "Preparation and characterization of activated carbon from waste tea using K2CO3", Biomass and Bioenergy, 2012, 37, 73-81.

* cited by examiner

*Primary Examiner* — Randy Boyer
(74) *Attorney, Agent, or Firm* — Field LLP

(57) ABSTRACT

Methods are provided for separation of bitumen from oil sands ore having a bitumen content higher than about 6%. Activated carbons, or combinations of activated carbons and caustic are used as process additives for ore-water slurry-based bitumen extraction processes or in situ bitumen recovery processes. These additives promote breakdown of adhesion between clay minerals and bitumen, resulting in the enhanced efficiency of extraction of bitumen from oil sands ore.

10 Claims, 8 Drawing Sheets

METHODS FOR ENHANCING EFFICIENCY OF BITUMEN EXTRACTION FROM OILSANDS USING ACTIVATED CARBON CONTAINING ADDITIVES

FIELD OF THE INVENTION

The present invention relates to methods and processes for increasing the efficiency of bitumen recovery from oil sands using water-slurry-based and in situ extraction processes. More particularly, the invention relates to the use of activated carbons, or combinations of activated carbons to enhance separation and recovery of bitumen from oil sand ores.

BACKGROUND OF THE INVENTION

Oil sand generally comprises water-wet sand grains held together by a matrix of viscous heavy oil or bitumen. In the Athabasca region of Alberta, oil sands deposits are typically composed of about 12% bitumen (by weight), 82% to 85% mineral matter (solids), and 3% to 6% water. Oil sands can be further categorized as "Poor ores" generally having low bitumen content (about 6 to about 10%) and "Good ores" having high bitumen content (about 10 to about 12% or higher). The Athabasca oil sand deposits may be efficiently extracted either by surface mining or by in-situ extraction processes that involve in injecting steam into the ore for purposes of the steam-assisted in situ bitumen recovery process. Since the 1960s, bitumen recovered from northern Alberta oil sands deposits has been upgraded to make synthetic crude oil at production rates as high as one million barrels per day.

The surface mining extraction is usually composed of the following steps: 1) the transportation of oil sand to crushing stations for size reduction, 2) the formation of an oil sand slurry in slurry preparation units where hot water is added and mixed, 3) the separation of oil sand slurry under quiescent conditions into a top layer of bitumen froth, a middle layer of middlings, and a bottom layer of coarse tailings. Between Step 2) and Step 3), the oil sand slurry may be further conditioned by transporting it using a hydrotransport pipeline to a primary separation vessel (PSV) for Step 3).

The top layer of bitumen froth is de-aerated, heated, and treated to produce diluted bitumen which is further processed to produce synthetic crude oil and other valuable commodities. The middle layer of middlings consists of warm water, fines, residual bitumen. "Fines" are particles such as fine quartz and other heavy minerals, colloidal clay or silt generally having any dimension less than about 44 μm. Poor ores generally have higher fine contents (about 30%), as compared with good ores with fines content less than 20%. The bottom layer of coarse tailings is composed of warm water, coarse solids and residual bitumen. "Coarse solids" are solids generally having any dimension greater than about 44 μm.

Recovery of bitumen from deep oil sands formations may be accomplished by well-known thermal methods such as underground bitumen combustion (i.e., in situ combustion, or ISC), or steam injection methods such as steam-assisted gravity drainage (SAGD) and cyclic steam stimulation (CSS). In these methods, the thermal energy injected into deep oil sands formations reduces the bitumen's viscosity and increases its mobility within the reservoir. Steam produced as an ISC by-product, or steam injected into a subsurface oil sands seam, condenses due to thermal energy losses and forms bitumen-water emulsions, which may be recovered by means of production wells. Hydrophilic fractions also help to promote the formation of bitumen-water emulsions under in situ recovery conditions, since they act as surfactants reducing surface and interfacial tensions, thereby helping to break down the oil sands ore structure and promoting the release of bitumen from the ore.

To improve bitumen recovery and froth quality caustic, often in the form of sodium hydroxide is often added to the oil sand slurry. Adding caustic leads to better bitumen-solids separation, which is achieved because caustic can facilitate the release of the water-soluble fraction of bitumen, that acts as a natural surfactant, to an aqueous phase. The addition of caustic also causes the precipitation of $Ca^{2+}$ and $Mg^{2+}$, and modifies the electrical surface potential of bitumen and solids, while adjusting the pH towards a more neutral or basic slurry, and make solids more hydrophilic.

However, there are many shortcomings in the use of caustic in oil sands extraction. Caustic is toxic and corrosive, impacting health and the environment and causing scaling on equipment. A higher caustic dosage is required for poor ores, but does not necessarily improve bitumen recovery and froth quality. Caustic disperses fines, hindering fines settling and tailings treatment. Higher caustic dosages induce bitumen emulsification which impairs froth treatment.

To minimize the amount of caustic used in bitumen extraction, a combination of sodium triphosphate or sodium citrate and caustic has been used in the past to condition the oil sand slurry, as descripted in CA2880959, "Sodium citrate and caustic as process aids for the extraction of bitumen from mined oil sands", ALBIAN SANDS, Jan. 28, 2015; CA2798260, "Sodium triphosphate and caustic as process aids for the extraction of bitumen from mined oil sands", SYNCRUDE, Dec. 4, 2012. Methods of enhancing separation and production of bitumen from oil sands ore by using lipids or lipid byproducts as process aids or additives for oil sands ore-water slurry-based extraction processes and for in situ recovery processes have also been disclosed (CA2640448, APEX ENGINEERING Oct. 6, 2008).

Activated carbons, also called activated charcoal, or activated coal, may be defined in general terms as a form of carbon processed to have small, low-volume pores that increase the surface available for adsorption or chemical reactions. An activation level sufficient for useful application may be attained solely from high surface area; however, further chemical treatment often enhances adsorption properties. Products of activated carbon can be different because of the types of pores and their large surface area ranging from 500 to 3000 $m^2/g$, variable characteristics of surface chemistry, and high degree of surface reactivity.

Activated carbons are classified in many ways, although a general classification can be made based on their physical characteristics, as powdered activated carbon, granular activated carbon, extruded activated carbon, impregnated carbon, polymer coated carbon and other types, such as cloths and fibres. They are used in specific applications. Powdered activated carbons are added directly to process units, granulated carbons are used for deodorization and for the separation of components in flow systems, extruded activated carbons are mainly used for gas phase applications, impregnated carbons are used for specific applications in air pollution control and polymer coated carbons are useful for hemoperfusion.

SUMMARY OF THE INVENTION

The current application is directed to methods of extracting bitumen from oil sand ores by adding activated carbons alone or a combination of activated carbons and caustic to condition the oil sand slurry for achieving an enhanced recovery of bitumen.

In one aspect the present invention provides a method of extracting bitumen from oil sand ores having a bitumen content higher than about 6 wt % is provided, comprising the steps of:

mixing the oil sand ore with water to form an oil sand slurry;

conditioning the oil sand slurry to form a conditioned oil sand slurry;

introducing a dosage of activated carbon at a stage selected from the group consisting of prior to mixing, during mixing, prior to conditioning, during conditioning and combinations thereof; and introducing the conditioned oil sand slurry into a separation zone to separate the slurry into a bitumen froth and tailings.

A method is also provided for enhancing recovery of bitumen from oil sands in conjunction with a steam-assisted in situ bitumen recovery process, comprising the step of introducing activated carbons into oil sands ore in situ, wherein the introduction of the activated carbon into the oil sands ore is effected by mixing the activated carbon powders into steam being injected into the ore for purposes of the steam-assisted in situ bitumen recovery process.

In a preferred embodiment, the dosage of activated carbon ranges from about 10 ppm (0.001 wt. %) to about 2000 ppm (0.2 wt. %) of the oil sand ore.

In a further preferred embodiment, the process further comprises adding a dosage of caustic at a stage selected from the group consisting of prior to mixing, during mixing, prior to conditioning, during conditioning and combinations thereof.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. The drawings depict only typical embodiments of the invention and are therefore not to be considered limiting of its scope. In the drawings.

The drawings are not necessarily to scale and in some instances proportions may have been exaggerated in order more clearly to depict certain features.

DETAILED DESCRIPTION OF VARIOUS EMBODIMENTS

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects.

The present invention relates generally to methods of extracting bitumen from mined oil sand ores by adding one or more activated carbon materials and/or a combination of activated carbons and caustic to the oil sand slurry.

Figure 1A:
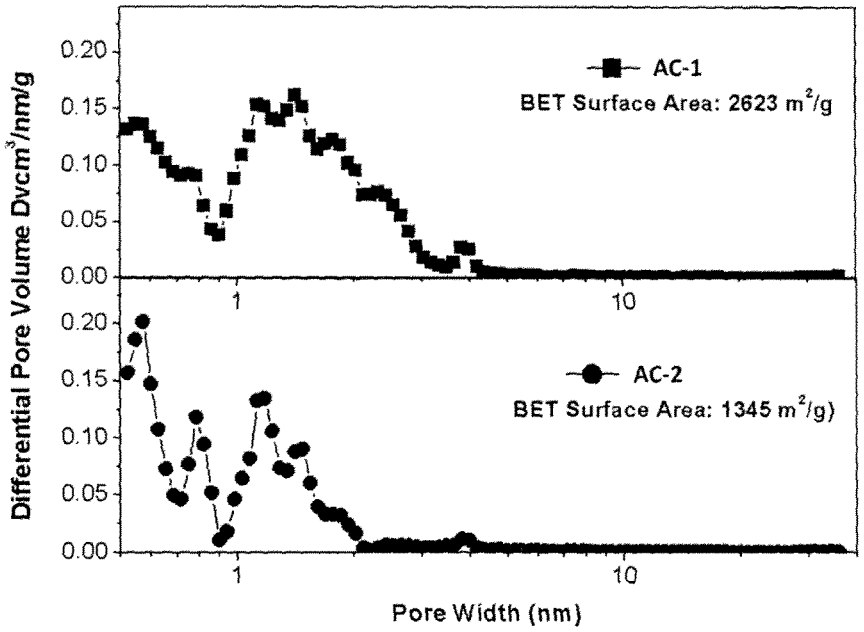
FIGS. 1*a* and *b* are graphs depicting the distribution of pore sizes vs. (a) cumulative pore volume and (b) differential pore volume of two activated carbons supplied by AdvEn Industries Inc. that were added to an oil sand slurry for enhanced extraction of bitumen.
Figure 1B:
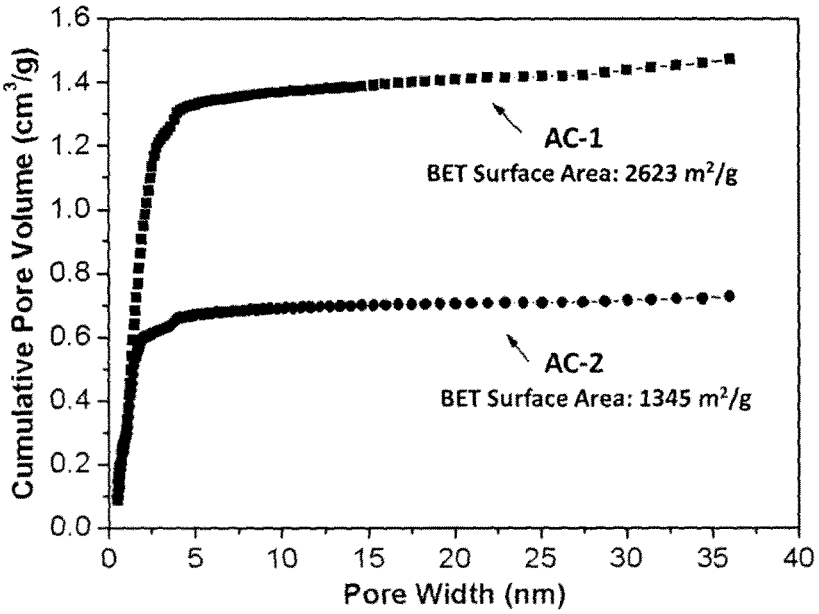

Products of activated carbon can vary in the types of pores, their surface area and other characteristics. Although activated carbons can be categorized by many different indices, the activated carbons involved in this invention are referred based on their specific surface area. FIG. 1 depicts the pore distribution of two examples of activated carbons that can be used in the present invention to enhance the rate of bitumen extraction. The pore widths depicted in FIG. 1*a*) are graphed against differential pore volume and FIG. 1*b*) shows the distribution relative to cumulative port volume. However it would be understood that any number of types of activated carbons could be used in the methods of the present invention without departing from the scope thereof. In these figures, the BET specific surface area is a measure of the amount of adsorption of a select inert gas such as nitrogen expressed in units of area per mass ($m^2/g$) of sample based on Brunauer, Emmett and Teller theory. The two activated carbon samples in FIGS. 1*a* and 1*b* are different primarily in their volumes of micro-pores, that is pores with a pore diameter of around or smaller than 2 nm.

In the methods of the present invention, oil sands are mixed with heated water in a slurry preparation unit. In addition to the oil sand and water, activated carbons are also added to the slurry preparation unit to aid in conditioning the oil sand slurry. Activated carbons and optionally other chemicals may be added to the water prior to mixing with oil sand, or added directly into the slurry preparation unit during mixing, or further alternatively, to the oil sand slurry prepared prior to hydrotransport and/or slurry conditioning.

In one aspect the present invention provides a method for extracting bitumen from an oil sand ore having a bitumen content higher than about 6 wt %. The method comprises:

mixing the oil sand ore with water to form an oil sand slurry in a primary extraction stage;

conditioning the oil sand slurry, for example, by mixing and/or introducing air flow, to form a conditioned oil sand slurry in a secondary extraction stage;

introducing a dosage of activated carbon at a stage selected from the group consisting of prior to mixing, during mixing, prior to conditioning, during conditioning and combinations thereof; and introducing the conditioned oil sand slurry into a separation zone to separate the slurry into a bitumen froth and tailings.

In a preferred embodiment, the dosage of activated carbon ranges from about 10 ppm (0.001 wt. %) to about 2000 ppm (0.1 wt. %) based on the oil sand ore and more preferably from 10 ppm (0.001 wt. %) to 2000 ppm (0.2 wt. %) of the oil sand ore.

The activated carbons of the present invention preferably have specific surface areas ranging from 500 $m^2/g$ to 3000 $m^2/g$, and more preferably in a range of from 1000 $m^2/g$ to 3000 $m^2/g$, and most preferably 2000 $m^2/g$ to 3000 $m^2/g$. The present activated carbon can be made up of a mix of macro-pores (pore diameter greater than 50 nm), meso-pores (pore diameter between 2 nm and 50 nm) and micro-pores (pore diameter about equal to or less than 2 nm). More preferably, the larger more and most preferred surface areas of the present activated carbons are made up of primarily micro-pores.

In a further preferred embodiment, the method may comprise adding a dosage of caustic to the process either prior to or during the mixing step or prior to or during the conditioning step or both, wherein the dosage of caustic is more preferably varied to obtain a pH value from 6 to 10 in the oil sand slurry. The caustic is more preferably sodium hydroxide, although any number of caustics can be used including but not limited to sodium hydroxide, potassium hydroxide, lye, calcium hydroxide, magnesium hydroxide.

Samples of two different oil sand ores were used for testing purposes, sourced from oil sands deposits in northern Alberta and obtained from Canada's Oil Sands Innovation Alliance. However, the present method can be used on any number of different compositions and types of oil sands ores without departing from the scope of the invention. In one embodiment of the present invention, oil sand ore was used that contained 12.0 wt % bitumen, which is referred to as the "Good Ore". In other examples, oil sand ore containing 8.0 wt. % bitumen was also tested, which is identified as the "Poor Ore".

Extraction of bitumen from the oil sands slurry in the present invention can be performed in two sequential stages. Primary extraction comprises bitumen extraction from the primary froth collected from mixing the oil sands ore with water to make the slurry. This froth is then collected and bitumen extracted therefrom. No air flow is introduced into the slurry in primary extraction. Secondary extraction refers to additional bitumen froth being extracted from the remaining slurry after primary extraction, by introducing air flow into the remaining slurry, also referred to as conditioning the oil sands slurry. The tiny air bubbles attach to the bitumen droplets and enhance floatation of bitumen to the top of the separation vessel. Total bitumen recovery is calculated as the sum of bitumen recovered from the primary and secondary extraction. In the present method, activated carbons with or without caustic can be added before or during either primary or secondary extraction stages or combinations thereof.

Laboratory tests were conducted to assess the effectiveness of a variety of activated carbons as process additives to enhance the efficiency of bitumen recovery from oil sands. The present inventors have surprisingly found that the use of activated carbon can improve bitumen recovery in all grade ores. It has further been found that a combined additive of one or more activated carbons and caustic can also improve bitumen recovery in all grades of ores.

The present invention can be practiced with a variety of types of activated carbons having different properties. It would be well understood by a person of skill in the art that varying pore sizes and pore volumes of activated carbons can vary the extraction performance. The variety of activated carbons can be used either on their own or functionalized with other individual atoms or chemical groups to further enhance their performance of bitumen recover. The other chemicals can be, for example, sodium triphosphate, sodium citrate, lipids, lipid byproducts and combinations thereof, Properties of activated carbon are: its specific surface area, iodine index, molasses index, tannin index, methylene blue index, butane index, carbon tetrachloride index, dechlorination half-value length, density, hardness number, ash content, porosity and particle size distribution. The indexes give an idea of the kind of pore volume a certain carbon has. Activated carbons are used in a wide range of applications that include medicinal uses, gas storage, pollutant and odor removal, gas separations, catalysis, gas purification, metal extraction, water purification, chromatographic separation, chemical purification, trapping mercury, fuel cells and many other applications. Carbon adsorption has numerous applications in industrial processes; such as spill clean-up, groundwater remediation, drinking water filtration, air purification, volatile organic compounds removal, gasoline dispensing operations, and other processes.

The optimal dosage of activated carbons can be varied based on a number of different properties including but not limited to oil sand ore quality, whether caustic is added and if so how much, and water content in oil sand slurry. Generally, the present inventors have found that lower dosages of activated carbons can be used when the bitumen content is higher and/or content of solid fines is lower, when the pH of oil sand slurry is high or is adjusted to be higher, when water content in oil sand slurry is low, and when temperature of oil sand slurry is increased.

In a further aspect of the present invention, the combined use of activated carbons and caustic has been observed to minimize the amount of caustic required, which in turn reduces problems normally encountered by use of high caustic dosages. Activated carbons are non-toxic to humans, animals, and the environment.

Thus, in one aspect of the present invention, use of the present methods may reduce the amounts of additives and process aids needed in bitumen extraction and improves bitumen recovery rates and froth quality. Froth quality improvement can be seen in FIGS. 10, 11, 12 and 13, in which the amount of water and solids found in the resulting bitumen froth is seen to decrease with addition of activated carbon.

The role of activated carbons played during promoting bitumen extraction is related to the slight electric negativity of carbon materials in aqueous solutions. This electric negativity facilitates the adsorption of metal ions, such as divalent calcium and magnesium rich in oil sand slurry to the surface of activated carbons.

$$AC^{-}+Ca^{2+}+H_2O=AC—Ca—(OH)_2+H^{+} \quad 1)$$

Adding caustic into activated carbon-doped oil sand slurry further promotes the reaction in Eq. 1), which leads to a reduction of pH. This is consistent with the slight reduction of pH of the water after extraction observed when both caustic and AC are added to the oil sad slurry.

When activated carbons are not added into oil sand slurry, the clays in the oil sands ores are inclined to attach onto the bitumen droplets by Van der Waals' attraction force, hindering the bitumen droplets from coalescencing together and form the froth layer on the surface. With the existence of divalent calcium and magnesium, a slime-like coating make the clays cling to the bitumen droplets bridged by divalent calcium and magnesium. This further prevents bitumen droplets from coalescence, leading to lower rate of bitumen recovery.

When activated carbon powders are added in oil sand slurry, divalent calcium and magnesium are attached to the surface of activated carbons through Reaction 1). This destroys the bridging between bitumen droplets and clay particles. Because of their lower density, activated carbons are floated to the surface and attached to bitumen layer. At the same time, negativity of activated carbon repels the negatively charged clays by electrostatic force after divalent calcium and magnesium are bonded to activated carbon. This prevents clay minerals from bonding to bitumen droplets.

The use of optimal dosage of activated carbons without adding sodium hydroxide or other chemicals in oil sand slurry generally resulted in higher overall bitumen recovery.

Figure 2:
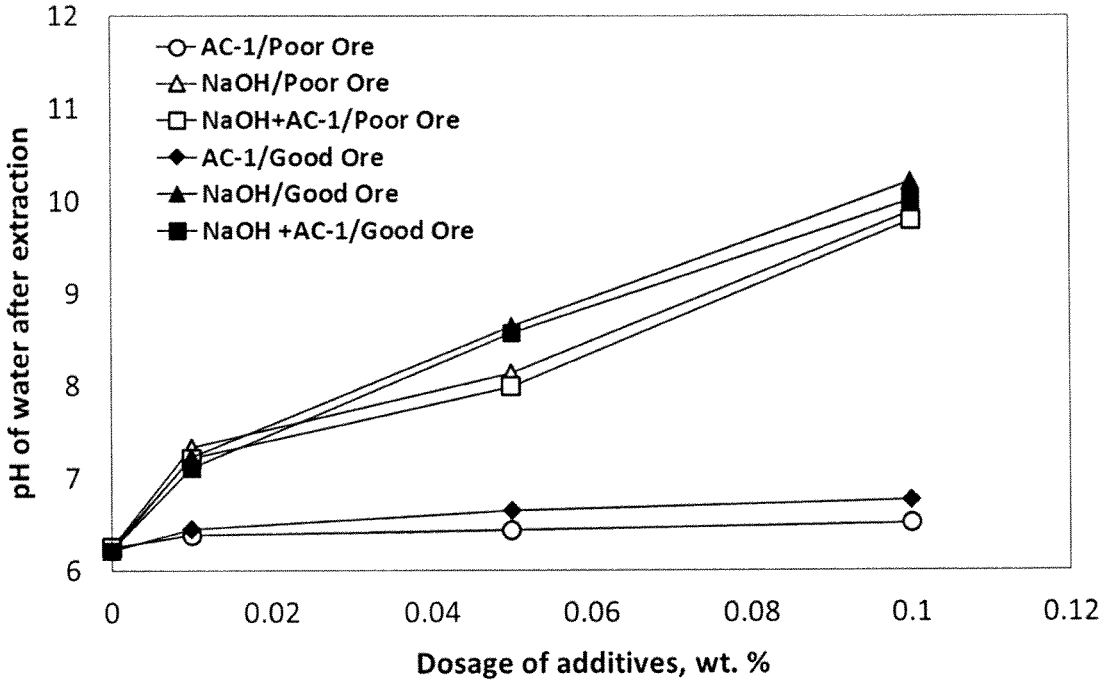
FIG. 2 is a graph depicting the effect of chemical additives on pH of remaining water measured after bitumen extraction from an oil sand having different bitumen contents.

With reference to FIG. 2, this graph shows the effect of chemical additives on pH of remaining water measured after bitumen extraction from the oil sand ores having 8% bitumen (Poor Ore) and 12% bitumen (Good Ore) using different dosages of two types of activated carbons (AC-1 and AC-2) with or without caustic being added into oil-sand slurry. In industry it is preferable to have the water after extraction as pH neutral as possible, since it is easier to reuse and recycle at a neutral pH.

For those tests with a combined addition of activated carbon and caustic, equal amount of activated carbon and caustic was added and only the amount of caustic, more specifically NaOH, was used to plot the Figures. This is because the current activated carbons are generally pH near-neutral and have only a minor effect of on pH of water measured after extraction. Accordingly, it was also observed that there is a slight increase of pH in the water after extraction when activated carbons were added alone.

By contrast, the pH of water after extraction with both activated carbon and causit addition increases almost linearly with increasing caustic dosage.

More preferably, an equal amount of activated carbons is added together with caustic in the method of the present invention. In such cases it has been observed that the pH of the water after bitumen extraction was decreased slightly towards a more neutral pH.

This shows a synergistic interaction between caustic and activated carbons, which leads to a slight reduction of pH of the water after extraction. The synergistic effect is clear considering the fact that activated carbons alone have been seen to slightly increase the pH of water after extraction when they are added alone.

Figure 3:
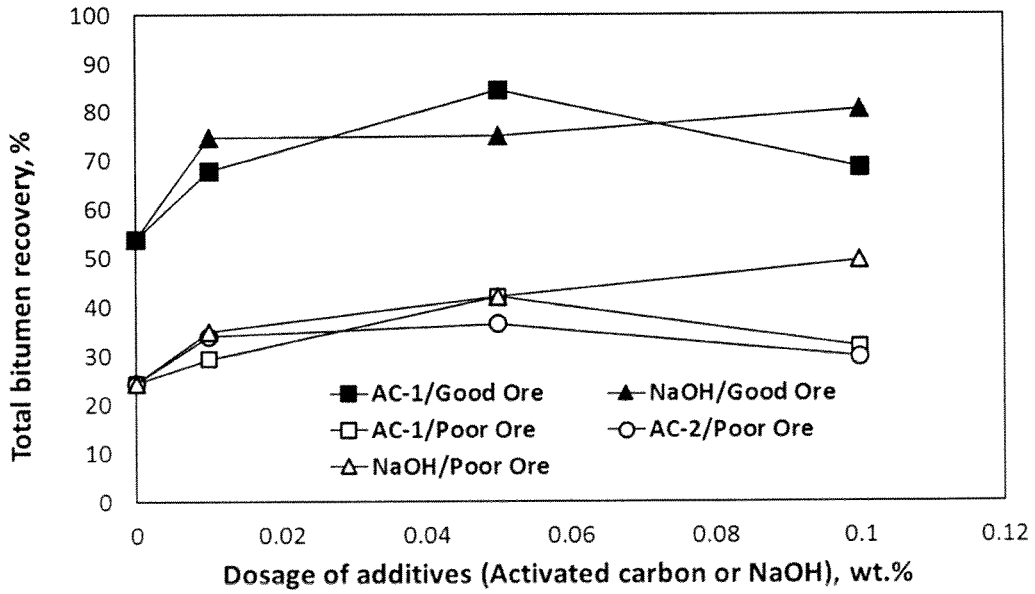
FIG. 3 is a graph depicting the variation of the total rate of extraction of bitumen from oil sand ores having different bitumen contents, with different dosages of chemical additives.

With reference to FIG. 3, this graph shows the variation of the total rate of extraction of bitumen from the oil sand ores having 8% bitumen (Poor Ore) and 12% bitumen (Good Ore) with different dosage of activated carbons (AC-1 or AC-2) and caustic being added separately into oil-sand slurry.

The values in FIG. 3 for bitumen content were determined by Dean-Stark extraction and gravimetric drying of 5 mL extract on filter paper. For each ore/caustic or ore/activated carbon combination tested, bitumen recovery was carried out in a cell for 5 minutes at 800 rpm, typically at a temperature of 55° C. Froth was scooped into a cellulose thimble and extracted with toluene in a Dean-Stark apparatus. Extract was adjusted to 250 mL in a volumetric flask, and 5 ml of extract was spread over a filter paper for overnight drying in a fume hood. The amount of recovered bitumen was determined from the weight difference of the filter.

Extraction test results for different ore/activated carbon or ore/caustic combinations are summarized in FIG. 3. The optimum dosage of activated carbons corresponding to the highest rate of bitumen recovery varies with the type of oil sand ores and the type of activated carbons.

In one embodiment of the present method, an optimized dosage of activated carbon addition alone is preferred as it produces higher extraction rates than that of caustic addition alone, especially for the good ore samples. It was also observed that total bitumen recovery is more greatly enhanced by activated carbon addition in good ores than in poor ores. It was also determined that activated carbons with a higher volume of micro-pores and/or higher specific surface area attributed to micro-pores show a greater enhancement of bitumen recovery, than those with lower specific areas. Specifically, more preferred are activated carbons having a surface area of from 1000 $m^2/g$ to about 3000 $m^2/g$, and being made up of primarily micro-pores.

Figure 4:
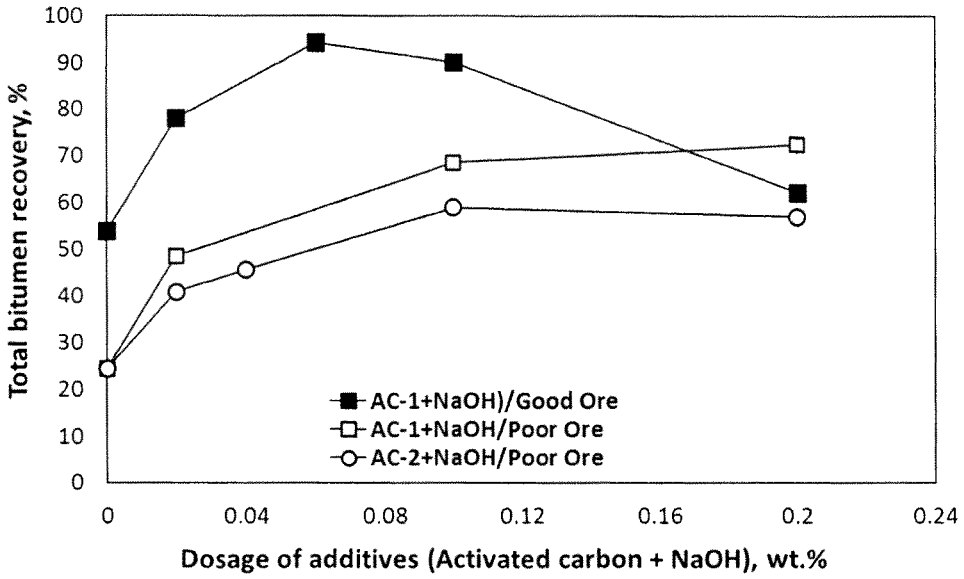
FIG. 4 is a graph depicting variation of the total rate of extraction of bitumen from oil sand ores having different bitumen content, with different dosages of activated carbon and caustic being added in combinations to the oil-sand slurry.

A synergistic interaction was also found between activated carbon and caustic, for example sodium hydroxide. FIG. 4 demonstrates the above synergistic interactions. The ratio of activated carbon to caustic in all the tests shown in FIG. 4 was 1:1 except for the highest point of total bitumen recovery at about 94.3% (the data point corresponding to 0.06 wt. % additives); this recovery was achieved by adding 0.01 wt. % NaOH and 0.05 wt. % AC-1 based on the total weight of oil sands. The present invention therefore provides a method of reducing the usage of toxic and corrosive caustic addition and at the same time achieving increased bitumen recovery rates.

Figure 5:
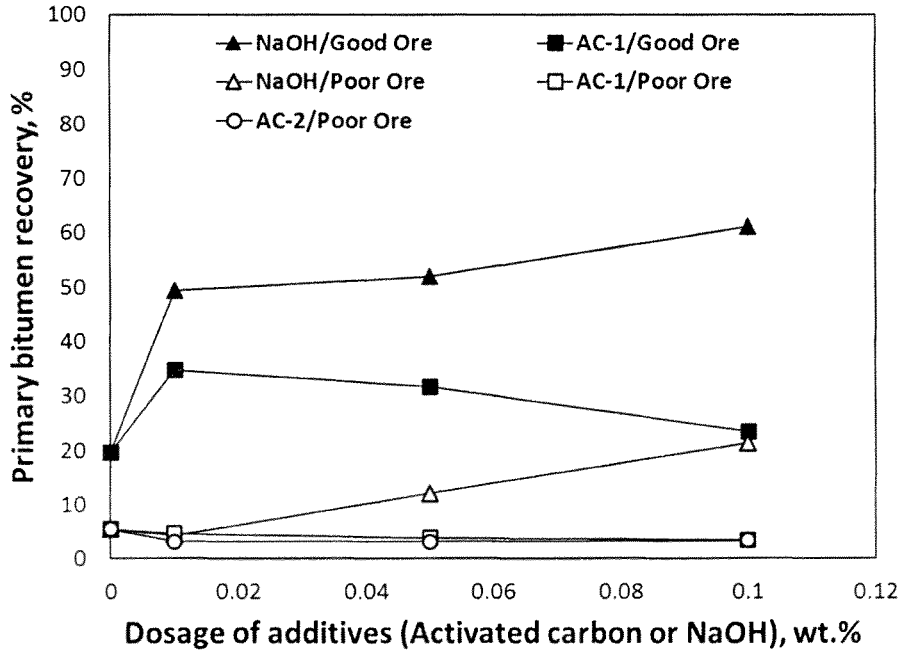
FIG. 5 is a graph depicting variations in the rate of primary extraction of bitumen from oil sand ores having different bitumen contents, with different dosage of activated carbons and caustic being added separately into oil-sand slurry.
Figure 6:
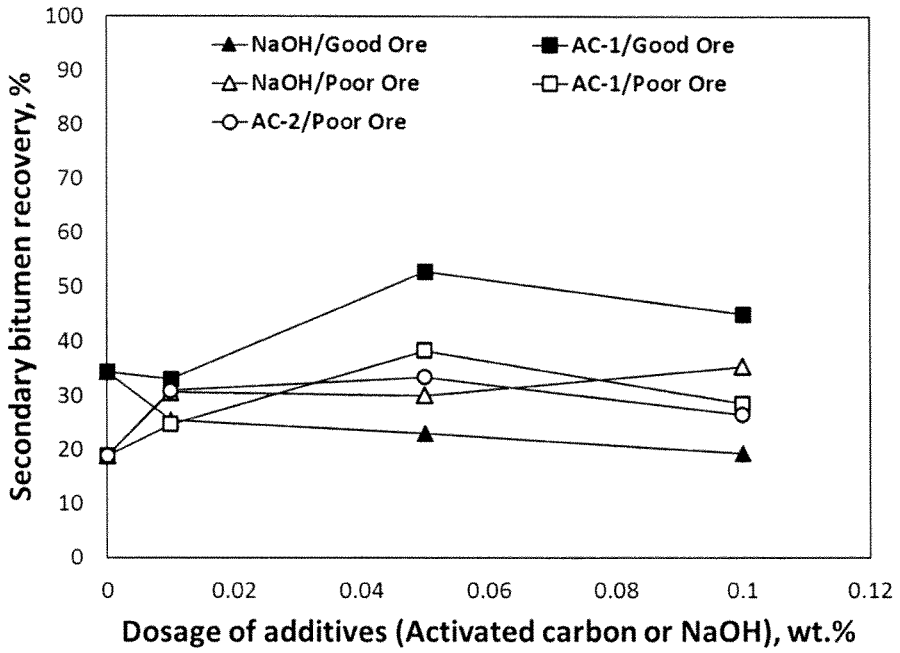
FIG. 6 is a graph depicting variations in the rate of secondary extraction of bitumen from oil sand ores having different bitumen contents, with different dosages of activated carbons and caustic being added separately into oil-sand slurry.

In the present invention, activated carbon addition alone has been observed to achieve higher secondary bitumen recovery than caustic alone. This is demonstrated in FIG. 5 and FIG. 6, in which the variation of both the primary and secondary extraction of bitumen with different dosage of activated carbons (AC-1 and AC-2) and caustic is shown.

Figure 7:
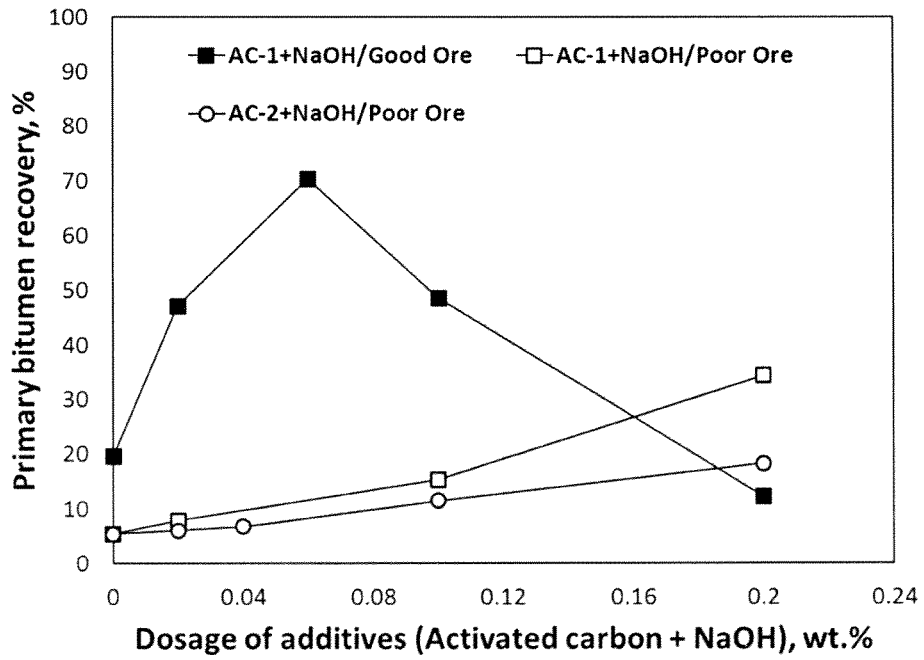
FIG. 7 is a graph depicting variations in the rate of primary extraction of bitumen from oil sand ores having different bitumen contents, with different dosage of activated carbon and caustic being added together into oil-sand slurry.

FIG. 7 shows the variation of the rate of primary extraction of bitumen from the oil sand ores having 8% bitumen (Poor Ore) and 12% bitumen (Good Ore) with different dosage of activated carbon (AC-1 or AC-2) and caustic being added together into oil-sand slurry. Surprisingly, the primary bitumen recovery is seen to be substantially enhanced when both caustic and activated carbon are added together. In FIG. 7, the value of dosage is the combined amount of caustic and activated carbon and the ratio of AC to NaOH was 1:1 except for the highest point of primary bitumen recovery (the data point at 0.06 wt. % additives) that was achieved by adding 0.01 wt. % NaOH and 0.05 wt. % AC-1, based on the total weight of oil sands.

Figure 8:
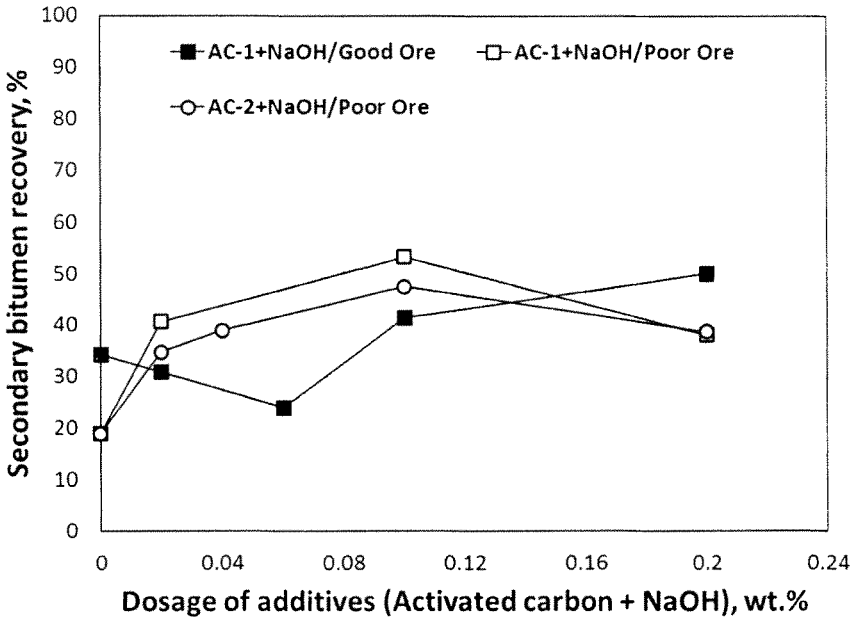
FIG. 8 is a graph depicting variations in the rate of secondary extraction of bitumen from oil sand ores having different bitumen contents, with different dosage of activated carbon and caustic being added together into oil-sand slurry.

The benefits of enhancing secondary bitumen recovery by addition of a combination of caustic and activated carbons is clearly demonstrated in FIG. 8. Secondary bitumen recovery of the good ore samples is relatively low simply because of effective primary recovery and low bitumen level left in the remaining ores.

Addition of caustic to adjust pH of oil sand slurry for the purpose of increasing bitumen extraction is a common industrial practice. Adding caustic or activated carbon alone in one embodiment of the present invention has been seen to increase the rate of bitumen extraction. Further preferably, addition of a combination of caustic and activated carbon further increases the rate of bitumen extraction.

Figure 9:
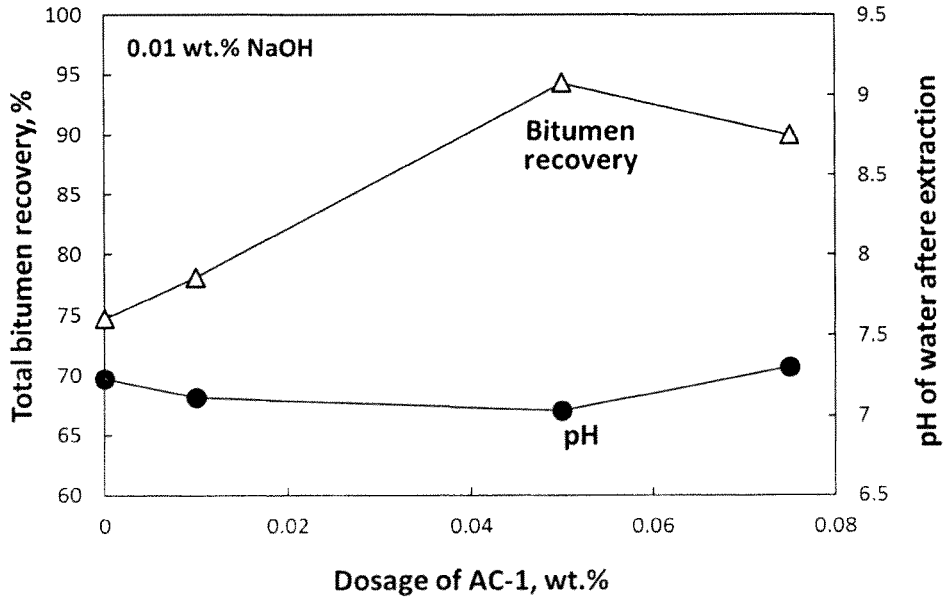
FIG. 9 is a graph depicting variations in the rate of total extraction of bitumen from oil sand ore samples having 12% bitumen (Good Ore) with different dosages of activated carbon and 0.01 wt. % caustic being added together into oil-sand slurry.

The present inventors have observed a relationship between optimum dosage of activated carbons at a given dosage of caustic. FIG. 9 shows the variation of total bitumen recovery with different dosages of activated carbons but a fixed dosage of caustic (0.01 wt. %). In the present invention, a range of between 0.01 to 0.1 wt. % of activated carbon can be added with a fixed dosage of 0.01 wt % of caustic. A more preferred, range is from 0.02 to 0.07 wt % of activated carbon with a fixed dosage of 0.01 wt % caustic. Under the test conditions, the optimal amount of activated carbons was found to be 0.05 wt. %. Within the range of dosage of activated carbons, pH of the water after extraction remained at near-neutral; that is from 6 to 9.

Figure 10:
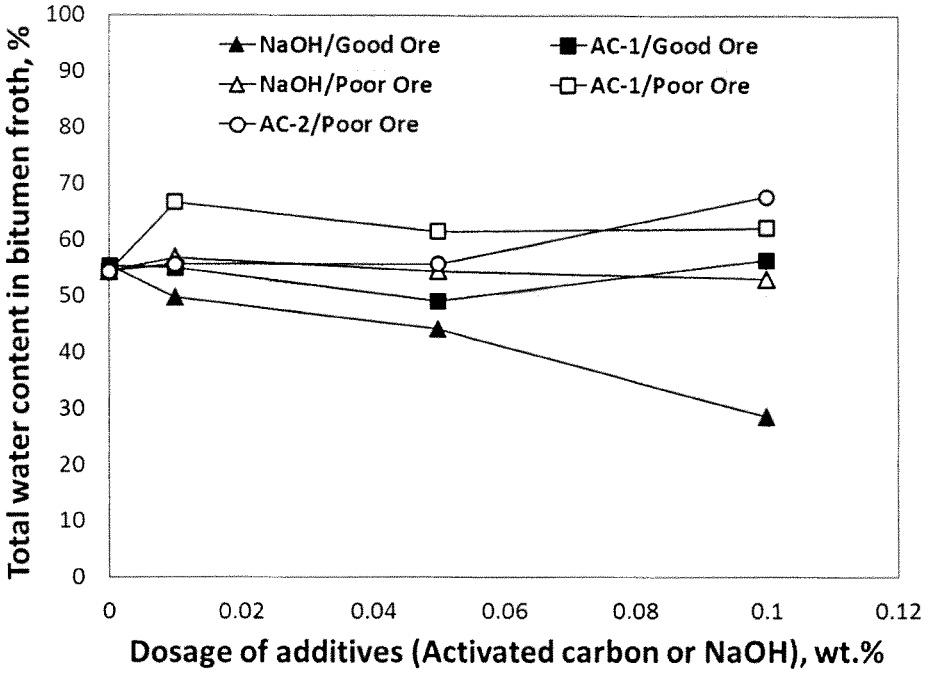
FIG. 10 is a graph depicting variations in the total water content in bitumen froth extracted from oil sand ores having different bitumen contents, with different dosages of activated carbons and caustic being added separately into oil-sand slurry.
Figure 11:
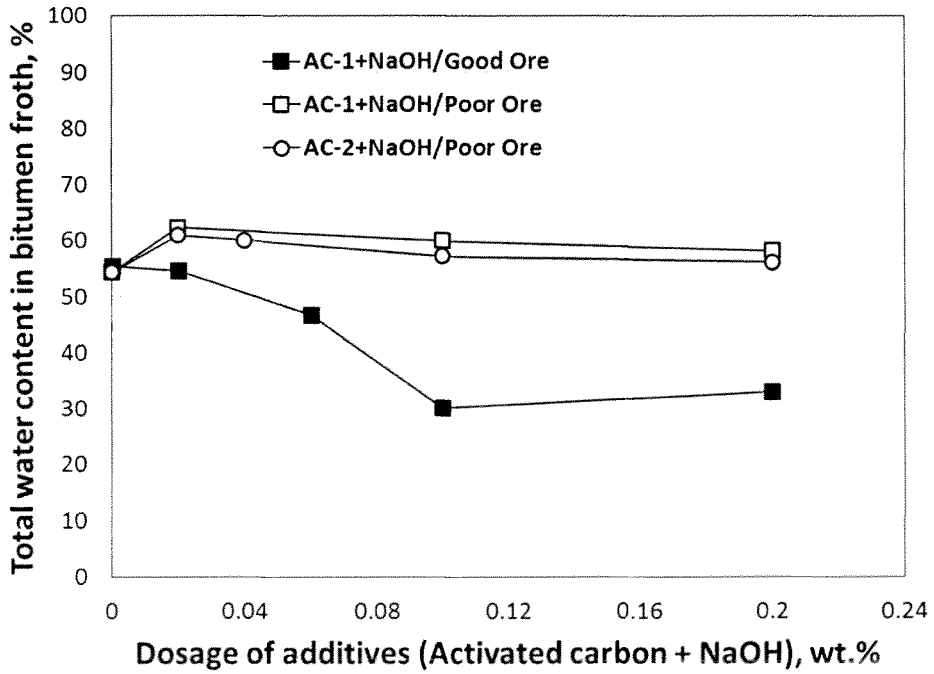
FIG. 11 is a graph depicting variations in the total water content in bitumen froth extracted from oil sand ores having different bitumen contents, with different dosage of activated carbon and caustic being added together into oil-sand slurry.

The amount of water contained in the froth was also analyzed. FIG. 10 shows the variation of the total water content in the bitumen froth extracted from the oil sand ores having 8% bitumen (Poor Ore) and 12% bitumen (Good Ore) with different dosage of activated carbons (AC-1 and AC-2) and caustic being added separately into oil-sand slurry. Adding activated carbon alone increases the water content in the bitumen froth. However, water content in bitumen froth is reduced when caustic and activated carbon are added together, as demonstrated in FIG. 11.

Figure 12:
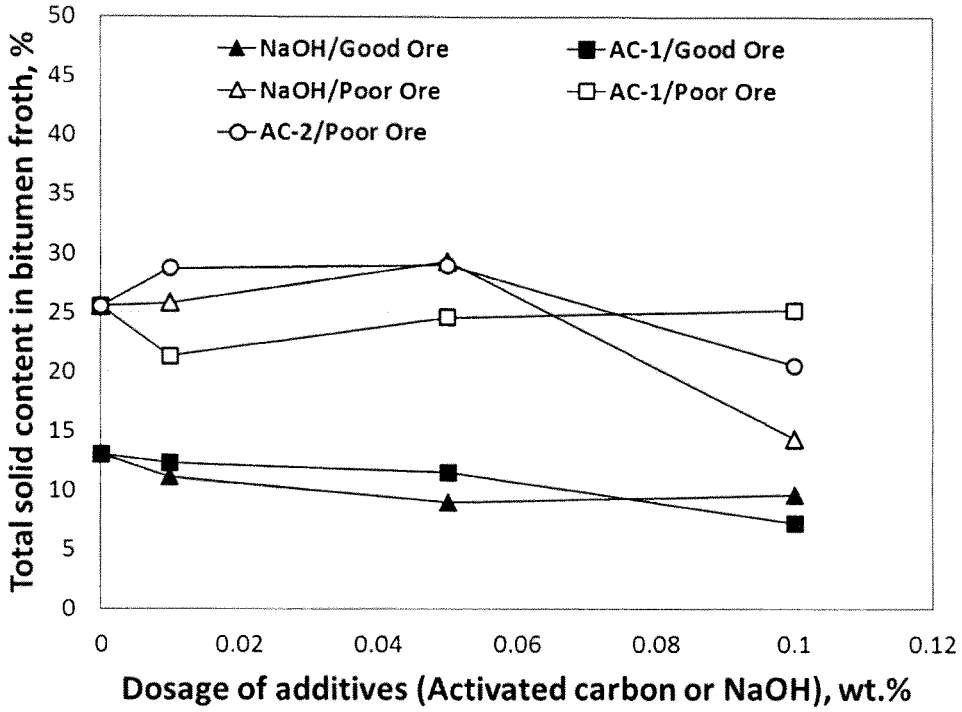
FIG. 12 is a graph depicting variations in the total solid content in the bitumen froth extracted from oil sand ores having different bitumen contents, with different dosage of activated carbons and caustic being added separately into oil-sand slurry.
Figure 13:
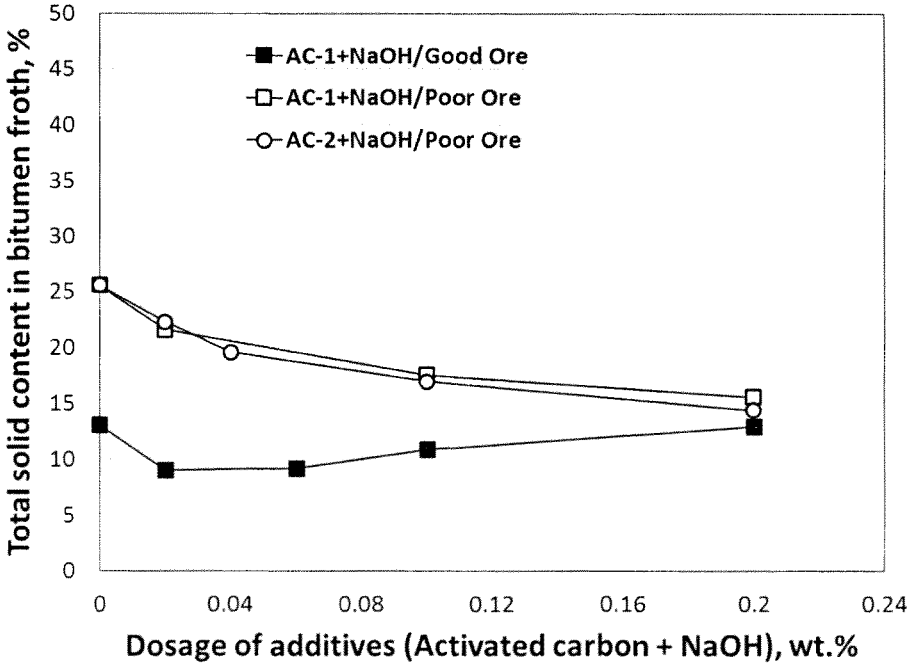
FIG. 13 is a graph depicting variations in the total solid content in the bitumen froth extracted from oil sand ores having different bitumen contents, with different dosage of activated carbon and caustic being added together into oil-sand slurry.

FIG. 12 shows the variation of the total solid content in the bitumen froth extracted from the oil sand ores having 8% bitumen (Poor Ore) and 12% bitumen (Good Ore) with different dosage of activated carbons (AC-1 and AC-2) and caustic being added separately into oil-sand slurry. Much lower solid content was in the froth of good ore samples having 12% bitumen. For the Good Ore, adding AC-1 or caustic can reduce solid content in the froth and caustic performs slightly better in lowering solid content than activated carbons. Adding AC-1 alone leads to much lower froth solid than adding caustic alone when their dosage is low. When activated carbon (AC-1) and caustic are added together, much reduced solid content is achieved for both the Good Ore and Poor Ore samples, as demonstrated in FIG. 13.

Figure 14:
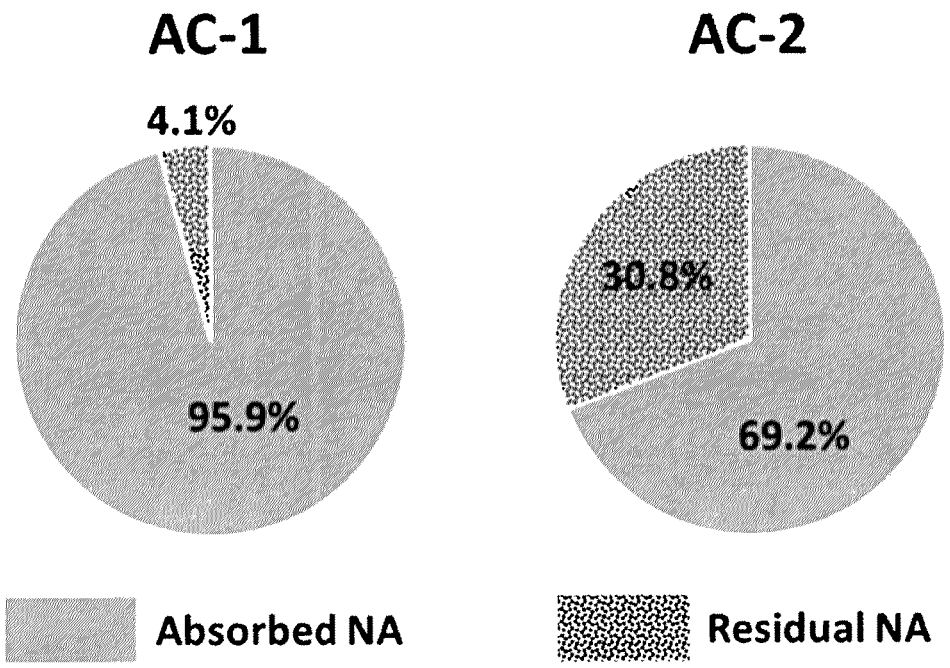
FIG. 14 are two pie-graphs depicting residual naphthenic acid in water remaining after bitumen extraction by methods of the present invention.

In addition to the benefit of enhancing bitumen recovery, using activated carbon could reduce toxic contaminants such as naphthenic acid, in water produced from the extraction of oil from oil sands. Naphthenic acid is a name for an unspecific mixture of several cyclopentyl and cyclohexyl carboxylic acids with molecular weight of 120 to well over 700 atomic mass units. Naphthenic acids are the major contaminant in water produced from the extraction of oil from Athabasca Oil sands. Naphthenic acids have both acute and chronic toxicity to fish and other organisms. Fractions that are rich in naphthenic acids can cause corrosion damage to oil refinery equipment; the phenomenon of naphthenic acid corrosion (NAC) has therefore been well researched. FIG. 14 is an example showing the remaining naphthenic acid (NA) after being adsorbed by adding the same dosage of two types of activated carbon (AC-1 and AC-2) into concentrated naphthenic acid containing water. AC-1 has achieved an adsorption percentage of 95.9%, close to full adsorption because of its much higher surface area attributed to larger volume of micro-pores.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed:

1. A method of extracting bitumen from oil sand ores having bitumen content higher than 6 wt %, comprising the steps of:

a. mixing the oil sand ore with heated water to form an oil sand slurry;

b. conditioning the oil sand slurry to form a conditioned oil sand slurry;

c. introducing a dosage of activated carbon powder at a stage selected from the group consisting of prior to mixing, during mixing, prior to conditioning, during conditioning and combinations thereof; and d. introducing the conditioned oil sand slurry into a separation zone to separate the slurry into a bitumen froth and tailings.

2. A method of enhancing bitumen extraction from oil sands ore, comprising the steps of:

a. mixing activated carbon powder into steam; and b. injecting said steam and activated carbon powder mixture into the oil sands ore for purposes of the steam-assisted in situ extraction of the bitumen from the oil sands ore.

3. The method as claimed in any one of claims 1 and 2, wherein the dosage of activated carbon ranges from 10 ppm (0.001 wt. %) to 2000 ppm (0.2 wt. %) of the oil sand ore.

4. The method as claimed in any one of claims 1 and 2, wherein the activated carbons have specific surface areas ranging from 500 $m^2/g$ to 3000 $m^2/g$.

5. The method as claimed in any one or claims land 2, wherein the activated carbons have been functionalized with other individual atoms or chemical groups to further enhance their performance of bitumen recovery.

6. The method as claimed in any one of claims 1 and 2, further comprising adding a dosage of caustic at a stage selected from the group consisting of prior to mixing, during mixing, prior to conditioning, during conditioning and combinations thereof.

7. The method as claimed in claim 6, wherein the caustic is added in a dosage to set the oil sand pH value to from 6 to 10.

8. The method as claimed in claim 6, wherein the caustic is sodium hydroxide.

9. The method as claimed in claim 2, wherein the steam-assisted in situ bitumen extraction process is a steam-assisted gravity drainage (SAGD) process.

10. The method as claimed in claim 2, wherein the steam-assisted in situ bitumen extraction process is a cyclic steam stimulation (CSS) process.

* * * * *